United States Patent [19]

Pabst

[11] Patent Number: 4,723,345

[45] Date of Patent: Feb. 9, 1988

[54] CHAIN CONVEYOR OF A FABRIC WEB STRETCHING MACHINE

[75] Inventor: Manfred Pabst, Cologne, Fed. Rep. of Germany

[73] Assignee: A. Monforts GmbH & Co., Monenchengladbach, Fed. Rep. of Germany

[21] Appl. No.: 7,269

[22] Filed: Jan. 27, 1987

[30] Foreign Application Priority Data

Jan. 25, 1986 [DE] Fed. Rep. of Germany ..... 3602233

[51] Int. Cl.[4] ..... D06C 3/02

[52] U.S. Cl. ..... 26/89; 26/93; 26/95; 26/96

[58] Field of Search ..... 26/89, 91, 93, 94, 95, 26/96, 73

[56] References Cited

U.S. PATENT DOCUMENTS

| | | | |
|---|---|---|---|
| 1,800,515 | 4/1931 | Edlich | 26/93 |
| 3,418,702 | 12/1968 | Coburn | 26/93 X |
| 3,457,608 | 7/1969 | Gaqeur | 26/93 |

*Primary Examiner*—Robert R. Mackey

*Attorney, Agent, or Firm*—Herbert L. Lerner; Laurence A. Greenberg

[57] ABSTRACT

A chain conveyor of a fabric web stretching machine includes input and output sides of the machine, an endless roller chain having a forward and rearward running parts, chain links, chain bolts absorbing longitudinal chain forces, stretching devices disposed at each of the chain links, a guide rail disposed at the forward running part forming a support for horizontally directed transverse forces to be exerted on the fabric web, chain wheels disposed at the input and output sides of the machine forming transitions between the forward and backward running parts each having teeth engaging in the chain at respective longitudinal ends of the guide rail, a transverse force roller being associated with each of the stretching devices for transferring transverse forces, roller bearings on which the transverse force rollers are supported about a vertical axis coaxial to a respective one of the chain bolts, the transverse force rollers abutting an outer surface of the guide rail facing away from the fabric web, the tooth rim and the teeth thereon of at least one of the chain wheels having a slit formed radially in the peripheral surface thereof perpendicular to the axis thereof, substantially centrally dividing the at least one chain wheel, and a support strip disposed within the forward and backward running parts and extending into the slit, the support strip having a support edge lying along a tangent of the root circle of the at least one chain wheel parallel to an adjacent part of the guide rail.

11 Claims, 5 Drawing Figures

CHAIN CONVEYOR OF A FABRIC WEB STRETCHING MACHINE

BACKGROUND OF THE INVENTION

1. Field of the Invention

The invention relates to a chain conveyor or chain line of an endless roller chain of a fabric web stretching machine or tenter frame or the like, including stretching or tentor means at each chain link, a guide rail for the forward running part of the chain, chain wheels forming transitions to the backward running part of the chain with teeth engaging the chain at the longitudinal ends of the guide rail, the guide rail forming a support for horizontally directed transverse forces to be exerted on the fabric web, each of the stretching or tenter means having a transverse force roller for transferring transverse forces, the transverse force rollers being supported on roller bearings about a vertical axis coaxial to the associated chain bolt absorbing longitudinal chain forces, and the transverse force rollers abutting the outer surface of the guide rail facing away from the fabric web.

2. Description of the Related Art

In stretching or tenter machines of this type, manufactured and sold by A. Monforts GmbH and Co., Monchengladbach, Federal Republic of Germany, a web of textile material is supported at the longitudinal edges thereof and is normally moved through a heat treatment area while being laterally stretched. A so-called chain conveyor or chain line is normally provided parallel to each of the longitudinal edges of the fabric web as stretching or tenter and fastening means in a machine which is generally known as a stretching machine or tenter frame. An endless roller chain moves in each of these chain conveyors or chain lines and has stretching or tenter means for fastening the fabric web. Needles and/or clips are used as stretching or tenter means. The roller chains are turned around at the input and the output sides of the machine. Each chain is propelled by one guide roller, which is normally in the form of a chain wheel at the output side of the machine.

Besides the chain wheels, a rail for the roller chain supporting the weight of the chains and at least one guide rail supporting the lateral forces created by the tentered fabric web, are associated with the chain conveyor or chain line. The lateral forces act perpendicularly to the tractive force which acts in the longitudinal direction of the chain from the chain drive.

According to German Published, Prosecuted Application DE-AS 14 60 640, if the stretching or tenter means are each provided with at least two transverse force rollers located at the side of the chain bolts, and if these rollers abut both longitudinal sides of the guide rail, the guide rail at the chain turning point at the input side of the machine extends uninterruptedly from the forward running part to the backward running part of this point. In this way, impact or shock points along the chain conveyor or chain line are avoided or limited to the degree absolutely necessary for the drive. However, the expenditure and effort required in connection with the known apparatus is considerable, because the chain bolts cannot be used as supports for the transverse force rollers and furthermore, additional rollers must be provided at each stretching or tenter means just for turning.

However, this large effort was necessary heretofore because it made it possible to avoid the polygonal movement of the chain encountered at the return of the chain. Especially during the high chain speeds of 200 m/min which are strived for, the polygonal movement causes very strong flapping of the chain and makes it difficult or impossible to catch the edges of the fabric web in the area where it is placed on the needles or clips. At the output side of the machine, the polygonal movement can also make the removal from the needles or clips more difficult and eventually prevent a straight cutting of the edge. Therefore, in the past it was often necessary either to utilize larger guide rollers corresponding to the increased machine speed or to install expensive dampers which are subject to wear, in order to reduce the polygonal movement. However, it is desirable, especially at the input side of the machine, to provide guide rollers which are as small as possible, so that the distance from the last guide drum before the chain to the point where the web is put on needles or clips is as short as possible and a turning in or turning over of the loose edges of the web is avoided in this area. The dampers are also unsatisfactory, especially at higher machine speeds, due to their performance as well as because of the wear and the noise generation connected therewith.

SUMMARY OF THE INVENTION

It is accordingly an object of the invention to provide a chain conveyor of a fabric web stretching machine, which overcomes the hereinafore-mentioned disadvantages of the heretofore-known devices of this general type and to remove the polygonal effect of the roller chain at the input side of the machine and preferably also at the output side of the machine without the need for providing specialized rollers on the chain and without increasing the turn-around radius.

With the foregoing and other objects in view, there is provided, in accordance with the invention, a chain conveyor or chain line of a fabric web stretching machine, tenter frame or the like, comprising an input side of the machine, an output side of the machine, an endless roller chain having a forward running part, a rearward running part, chain links, chain bolts absorbing longitudinal chain forces, stretching or tenter means disposed at each of the chain links, a guide rail disposed at the forward running part forming a support for horizontally directed transverse forces to be exerted on the fabric web, the guide rail having longitudinal ends and an outer surface facing away from the fabric web, chain wheels disposed at the input and output sides of the machine forming transitions between the forward and backward running parts, each of the chain wheels having an axis, a root circle, a peripheral surface, a tooth rim and teeth disposed on the tooth rim and engaging in the chain at a respective one of the longitudinal ends of the guide rail, a transverse force roller being associated with each of the stretching means for transferring transverse forces, roller bearings on which the transverse force rollers are supported about a vertical axis coaxial to a respective one of the chain bolts, the transverse force rollers abutting the outer surface of the guide rail, the teeth and the tooth rim of the chain wheel at the input and/or output side having a slit formed radially in the peripheral surface thereof perpendicular to the axis thereof, substantially centrally dividing the at least one chain wheel, and a support strip disposed within the forward and backward running parts and extending into the slit, the support strip having a support edge lying along a tangent of the root circle of the at least one chain wheel parallel to an adjacent part of the guide rail.

According to the invention, the chain is no longer subject to the disruptive polygonal movement when the teeth are being engaged in the chain or being disengaged from the chain when it runs up on the chain wheel or runs off the chain wheel, since the transverse force rollers roll or slide along one of the support edges during run up or run off at the chain wheel until they meet the chain wheel root circle. Since the advantages of a chain wheel for the guidance and drive of the chain are retained according to the invention, while nevertheless providing smooth support edges in the areas critical for the polygonal effect and for the roll-off of the already present transverse force rollers of the chain supported on ball bearings, the support strips according to the present invention can be provided at the input side of the machine as well as at the output side of the machine, normally having a driven chain wheel.

In accordance with the invention, a support strip or support edge is primarily provided at the spot where an otherwise occurring polygonal effect would be most disruptive. Normally the largest problems in this regard occur in the forward running part of the chain at the input side of the machine, where the fabric web to be treated must be grasped at the edges. Of course, support edges can also be provided at one, several or all other roll-off or roll-on sides of the two chain wheels tightening the roller chain in the longitudinal direction of the machine.

The support edges of the support strips should be adjusted in such a way that as quiet a chain operation as possible results. Such a position is normally obtained when the support edges lie exactly on the tangent of the point of the chain wheel root circle from which or onto which the chain is to roll. During adjustment, it should be noted that the forward running part or the backward running part of the chain need not run parallel to each other due to the placement in the chain conveyor or chain line, especially at the input side of the machine. At the forward running part of the chain, the support edge should generally be aligned parallel to the guide rail provided there.

In accordance with another feature of the invention, two separate and separately adjustable support strips or support strips combined into a single plate and having two parallel support edges on opposite edges of the plate can be provided on one or both chain wheels, and the distance between the support edges should be about equal to the diameter of the chain wheel root circle. Adjustment of such a plate is primarily done in regard to quiet operation in the forward running part of the chain. Such a rigid plate can be used when the chain sections to be guided by the support edges in the forward and backward running parts of the chain always include approximately the same angle during operation of the machine or if a quiet chain operation, which is an object of the invention, can be achieved despite possible angular changes.

In accordance with a further feature of the invention, the transverse force rollers have a given diameter and the support edge and the guide rail are disposed along straight lines in the forward running spaced apart by a distance substantially equal to or only slightly larger than the given diameter. In other words, this distance should be just large enough so that the rollers can glide or roll between support edge and guide rail without catching when both lie next to each other.

In accordance with again an added feature of the invention, two of the transverse force rollers are spaced apart by a given distance, and the support edge and the guide rail define opposite sides of a path of the roller chain at least along a length corresponding to the given distance. Therefore, it is sufficient if the supporting edge and the guide rails limit the path of the roller chain, from mutually opposite sides, at least for a distance equivalent to the length of two transverse force rollers.

The slit dividing the chain wheel centrally and approximately halving it perpendicular to the chain wheel axis, need not extend entirely through the chain wheel. It is sufficient if, in accordance with an added feature of the invention, the teeth have a given height and the slit extends into the tooth rim to a depth substantially equal to the given tooth height. The dimensions of the slit in this case are selected in such a way that the support strip beginning at the slit and including play for the turning of the chain wheel, has an overall stability necessary to prevent the polygonal effect, and that even with constant operation there can be no scraping of the chain wheel on the support strip.

The slit portion within the toothed rim is required so that the transverse force rollers roll onto the guide strip and can no longer be subject to polygonal vibrations, even at the point where the chain would theoretically roll off tangentially from the chain wheel root circle or onto the chain wheel root circle. The support strip should extend from this beginning point of the tangent so far in the direction of the tangent, that the chain can no longer be reached by the chain teeth. In this sense, the respective support edge should extend at least from the beginning point of the tangent at the root circle of the chain wheel to the intersecting point of the tangent with the tip circle of the chain wheel. If appropriate, for reasons of mechanical stability and strength of the support strip or support plate in connection with the respective support edge it might, however, be advantageous to enlarge the support edge substantially beyond the above-mentioned intersecting point of the root circle tangent and the tip circle.

In accordance with an additional feature of the invention, the support plate has an edge facing toward the axis of the chain wheel, the edge having a recess formed therein for the axis of the chain wheel. Should comparatively wide support strips or a compact support plate be inserted into the slits of the chain wheel and if it is desired to let the respective support strip begin at the above-mentioned origin of the tangent, it might become necessary to provide such a recess, which may be semicircular corresponding to the radius of the chain wheel core remaining at the bottom of the slit.

The chain wheel and especially its teeth are weakened by the slit approximately centrally dividing the chain wheel in the direction from the edge. It might therefore be useful to strengthen the chain wheel and its teeth in the direction toward the axis of the chain wheel. Such reinforcement would, of course, necessitate an adjustment of the chain used.

In accordance with again an additional feature of the invention, there is provided an adjustment device on which the support strip is fastened or the support strips forming the support plate are fastened for aligning the support edge to provide a chain movement as quiet as possible In accordance with yet another feature of the invention, the chain wheels have tip circles having circular rings, the root circles have circular rings, the support strip or each of the support strips forming the support plate has a groove formed therein in the form of a recess along the circular rings, the slit has a width in the teeth corresponding to the thickness of the support strips at the groove, and the slit has a width in the toothed rim corresponding to the thickness of the support strip outside the groove. This could be advantageous if an adjustment of the chain is not desired, but in spite of this, comparatively heavy support strips or support plates are to be employed in order to prevent the polygonal effect in a stable and enduring way. This can be done in such a way, that the slit width in the area of the teeth still compatible with the stability of the teeth corresponds to the thickness of the plate or the support strips in the area of the groove. A greater thickness of the support strips or the support plate can then be provided radially within this circular ring, since the chain wheel can be strengthened in this area independently of the respective chain provided and therefore can be provided with a larger slit width than in the area of the teeth. Of course the support strip or the plate can also be made considerably thicker radially outside of the circular ring shaped groove than in the area swept by the teeth and defined by the root circle and the tip circle.

In accordance with a concomitant feature of the invention, the support plate is disposed at the input side of the machine, and including another support strip or two other support strips forming a support plate disposed at the output side of the machine.

Other features which are considered as characteristic for the invention are set forth in the appended claims.

Although the invention is illustrated and described herein as embodied in a chain conveyor of a fabric web stretching machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
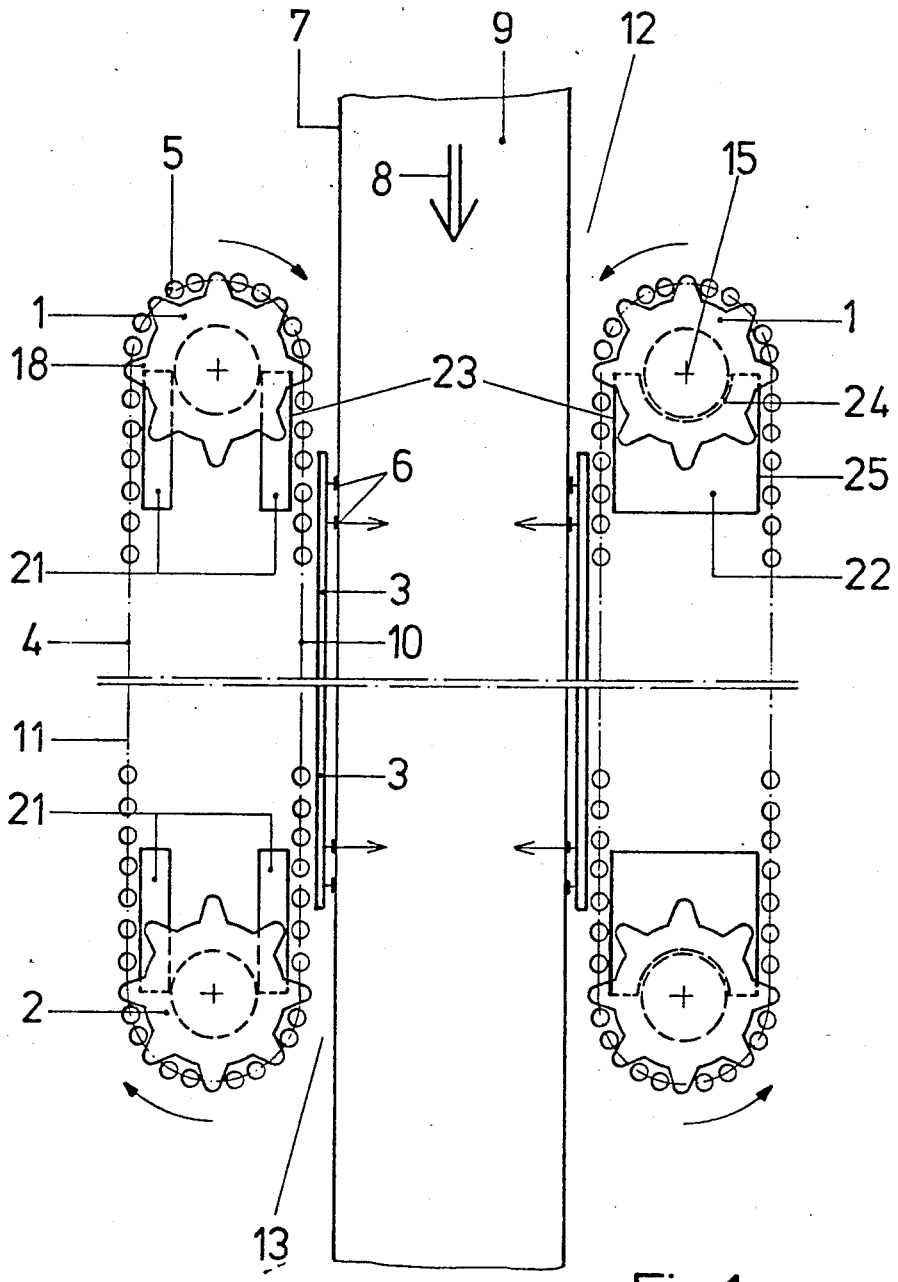
FIG. 1 is a diagrammatic top-plan view of chain conveyors or chain lines of a stretching or tenter frame.
Figure 2:
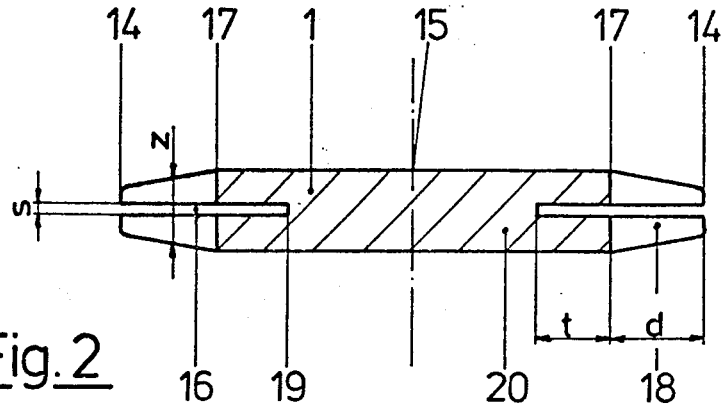
FIG. 2 is a cross-sectional view parallel to the rotational axis of a chain wheel.
Figure 3:
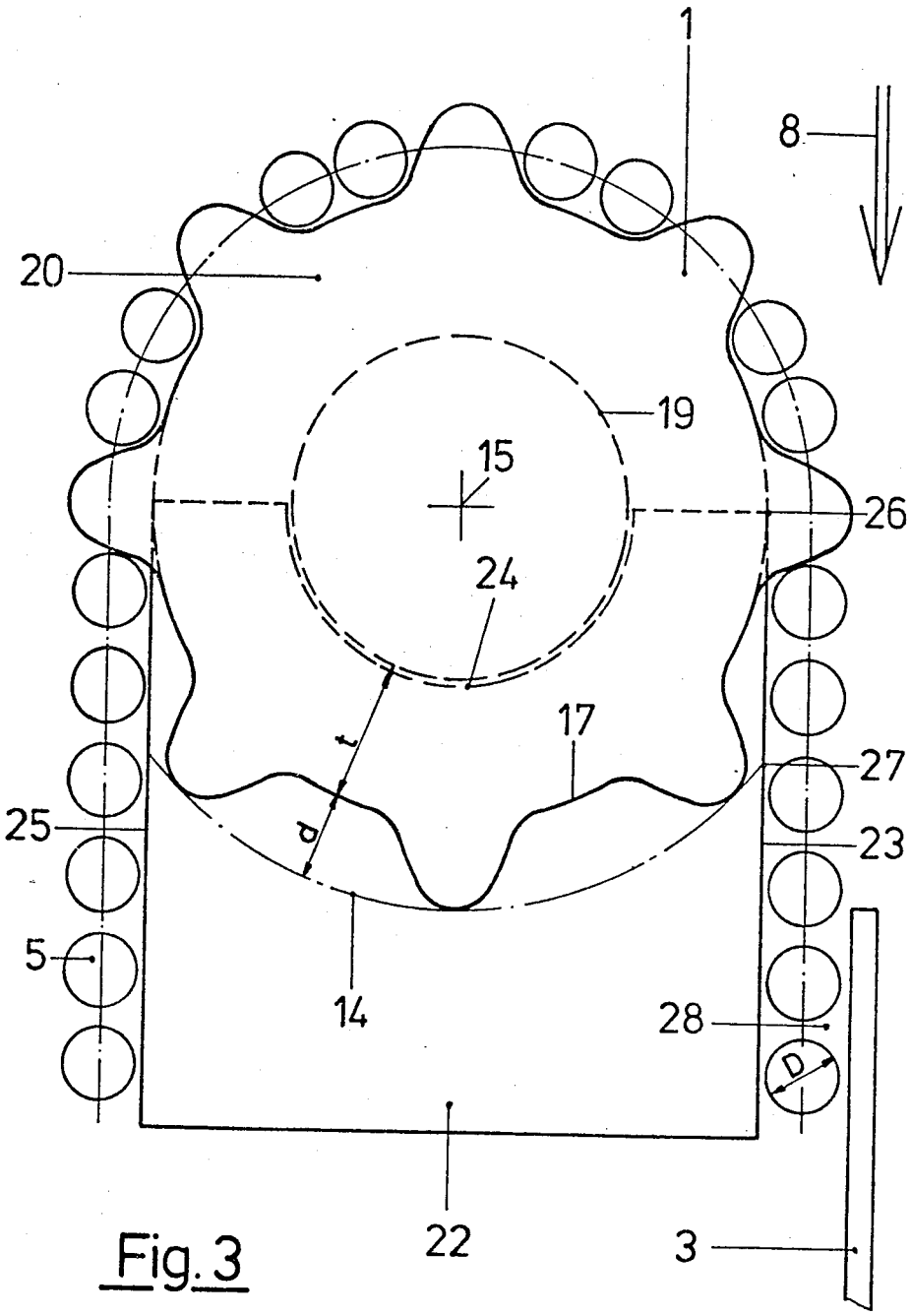
FIG. 3 is a fragmentary, enlarged, top-plan view of a chain wheel with a roller chain and a support plate.

Referring now to the figures of the drawings in detail and first, particularly, to the first embodiment of FIGS. 1 to 3 thereof, there is seen a top view of a stretching or tenter frame in FIG. 1 showing chain conveyors or chain lines in greatly distorted and enlarged form. In accordance with FIGS. 1 and 3, the chain conveyors or chain lines are mainly formed of chain wheels 1 and 2, guide rails 3 absorbing lateral forces, as well as additional non-illustrated rolling, sliding and guiding means. Two roller chains are designated in their entirety with reference numeral 4 and are formed of chain links symbolized by transverse force rollers 5. Stretching or tenter means 6 are provided at each chain link for the capture of the longitudinal edge 7 of a fabric web 9 moved through the machine in the forward direction 8. A forwardly running part 10 of the roller chain 4 moves between the toothed chain wheels 1 and 2 in the direction of the arrow 8. A backwardly running part 11 of the chain moves opposite to the forward direction 8. As a rule, the chain wheels 1 at an input side 12 of the machine are not driven but are free-running wheels. The roller chains 4 are driven by means of the two chain wheels 2 located at an output side 13 of the machine, through non-illustrated drive means.

In accordance with the invention as shown in FIGS. 2 and 3, at least the chain wheels 1 at the input side 12 of the machine are circumferentially divided approximately centrally from the periphery, i.e. radially from a tip circle or crown line or circle 14 by a slit 16 extending perpendicularly to the axis 15 of the chain wheel 1. The slit 16 need not extend entirely through the chain wheel 1, rather it is sufficient to bring it only up to a depth t which is in the order of the height of teeth 18, i.e. in the order of a distance d between the tip circle 14 and a root circle 17 of the teeth 18, namely to bring the slit up to a slit are 19 in a toothed rim 20.

Furthermore, a support strip 21 and/or a support plate 22 with a support edge 23 having a tangent extending parallel to the adjacent part of the guide rail 3, is inserted into the slit 16 within the chain part, that is within the region enclosed by the roller chain 4. The support strip 21 or the support plate 22 are inserted far enough into the slit 16 that the support edge 23 reaches to the point of the root circle 17 from which the roller chain 4 should theoretically be drawn off in a straight line. Therefore, at least when using a support plate 22, it is generally necessary to provide a recess 24 in the side of the plate facing toward the axis 15 of the chain wheel, which makes it possible to bring the support edge 23 up to the theoretical roll-off or roll-on point of the chain at the root circle 17 of the chain wheel 1 and 2, even if the slit 16 does not penetrate the chain wheel.

In general, it is especially advantageous to provide a support edge 23 for preventing polygonal movement of the roller chain 4, at the point where the chain rolls off the chain wheel 1 into the forward running part 10 of the chain, since an especially undisturbed chain motion is desired at this point for an orderly fastening of the edge 7 of the fabric web 9. A similarly undisturbed chain motion is desired at the point where the roller chain 4 rolls onto the chain wheel 2 at the output side 13 of the machine, because the edge of the fabric web might have to be cut off cleanly and straight at that location. In general, it should be sufficient to apply support strips 21 or support edges 23 in these regions of the roller chain 4 approximately as indicated on the left side of FIG. 1. However, since the polygonal movement also occurs in the backward running part 11 of the chain and since it causes at least considerable noise at that location, it might be advantageous to also provide support edges 23 at the corresponding roll-on and roll-off points of the chain and the chain wheel. Separate support strips 21 as in the forward running part 10 of the chain or whole support plates 23 for the forward running part 10 of the chain and support edges 25 for the backward running part 11 can be used.

The lengths of the respective support edges 23 and 25 should extend at least from an origin 26 of a tangent at the root circle 17 to an intersection point 27 of the tangent with the tip circle 14. It is also advantageous for an undisturbed chain movement if the support edge 23 and the guide rail 3 run parallel for a distance of approximately two chain links and if the distance between the support edge 23 and the guide rail 3 in this region is only slightly larger than the diameter D of a roller 5, so that the chain can glide through a channel 28 created between the guide rail 3 and the support edge 23, without being caught.

Due to the minimum stability of the teeth 18 of the chain wheel 1, 2 which is required after cutting the slit 16, the ratio of the slit width s to the tooth thickness z, as measured in the direction of the axis 15 of the chain wheel in FIG. 2, cannot exceed a given value s/z. Accordingly, the thickness of the respective support strip 21 or support plate 23 to be inserted into the slit 16, is also limited.

Figure 4:
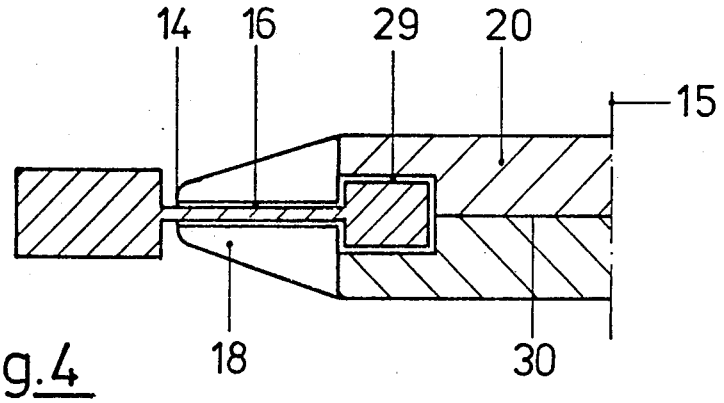
FIG. 4 is a fragmentary cross-sectional view parallel to the rotational axis of a chain wheel with a strengthened toothed rim, taken along the line IV—IV in FIG. 5.
Figure 5:
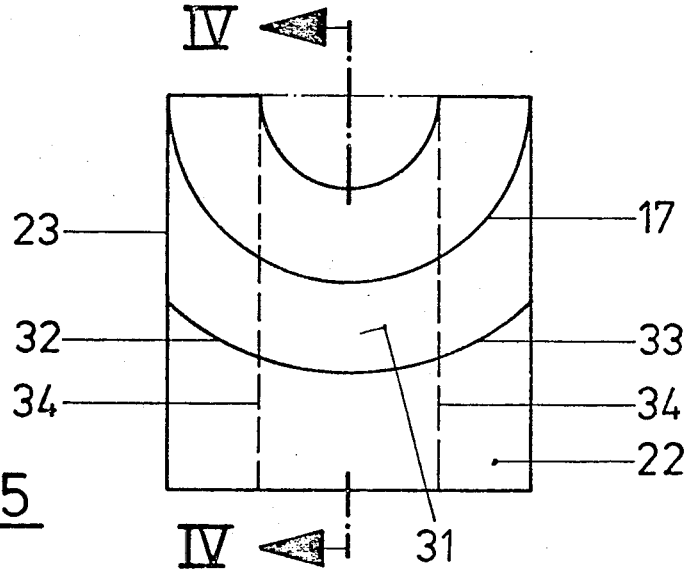
FIG. 5 is a top-plan view of an adjusting plate according to FIG. 4.

According to FIGS. 4 and 5, a stabilization of the support means can also be accomplished with the presence of a relatively narrow slit 16, provided a slit 29 within the toothed rim 20 is strengthened considerably relative to the slit 16 within the teeth 18. A correspondingly required difference in the thickness of the teeth 18 and the toothed rim 20 (as seen by the section in FIG. 4 taken along the line IV—IV of FIG. 5) is also possible without difficulty, while retaining the remaining dimensions of the chain conveyor or chain line and the chain. Appropriately, however, the chain wheel 1 should then be formed in two parts with a dividing line 30 perpendicular to the axis 15. An appropriate support plate 22 should have an approximately annular groove 31, the bordering circular edges 32 and 33 thereof successively corresponding to the tip circle 14 and the root circle 17 of the teeth 18. In the embodiment according to FIG. 5, support strips 21 can be used instead of the support plate 22. The central part of the plate 22 between the broken lines 34 would then not be present.

I claim:

1. Chain conveyor of a fabric web stretching machine, comprising an input side of the machine, an output side of the machine, an endless roller chain having a forward running part, a rearward running part, chain links, chain bolts absorbing longitudinal chain forces, stretching means disposed at each of said chain links, a guide rail disposed at said forward running part forming a support for horizontally directed transverse forces to be exerted on the fabric web, said guide rail having longitudinal ends and an outer surface facing away from the fabric web, chain wheels disposed at said input and output sides of the machine forming transitions between said forward and backward running parts, each of said chain wheels having an axis, a root circle, a peripheral surface, a tooth rim and teeth disposed on said tooth rim and engaging in said chain at a respective one of said longitudinal ends of said guide rail, a transverse force roller being associated with each of said stretching means for transferring transverse forces, roller bearings on which said transverse force rollers are supported about a vertical axis coaxial to a respective one of said chain bolts, said transverse force rollers abutting said outer surface of said guide rail, said teeth and said tooth rim of at least one of said chain wheels having a slit formed radially in said peripheral surface thereof perpendicular to said axis thereof, substantially centrally dividing said at least one chain wheel, and a support strip disposed within said forward and backward running parts and extending into said slit, said support strip having a support edge lying along a tangent of said root circle of said at least one chain wheel parallel to an adjacent part of said guide rail.

2. Chain conveyor according to claim 1, wherein said teeth have a given height and said slit extends into said tooth rim to a depth substantially equal to said given tooth height.

3. Chain conveyor according to claim 1, wherein said transverse force rollers have a given diameter and said support edge and said guide rail are disposed along straight lines in said forward running part spaced apart by a distance substantially equal to said given diameter.

4. Chain conveyor according to claim 3, wherein two of said transverse force rollers are spaced apart by a given distance, and said support edge and said guide rail define opposite sides of a path of said roller chain at least along a length corresponding to said given distance.

5. Chain conveyor according to claim 1, including another support strip with a support edge, each of said support strips being disposed at a respective one of said forward and backward running parts of said chain adjacent said chain wheel having said slit formed therein.

6. Chain conveyor according to claim 5, wherein said support strips are a part of a support plate.

7. Chain conveyor according to claim 6, wherein said support plate has an edge facing toward said axis of said chain wheel, said edge having a recess formed therein for said axis of said chain wheel.

8. Chain conveyor according to claim 7, wherein said chain wheels have tip circles having circular rings, said root circles have circular rings, each of said support strips forming said support plate has a groove formed therein in the form of a recess along said circular rings, said slit has a width in said said teeth corresponding to the thickness of said support strips at said groove, and said slit has a width in said toothed rim corresponding to the thickness of said support strip outside said groove.

9. Chain conveyor according to claim 1, wherein said chain wheels have tip circles having circular rings, said root circles have circular rings, said support strip has a groove formed therein in the form of a recess along said circular rings, said slit has a width in said teeth corresponding to the thickness of said support strips at said groove, and said slit has a width in said toothed rim corresponding to the thickness of said support strip outside said groove.

10. Chain conveyor according to claim 9, wherein said support plate is disposed at said input side of the machine, and including two other support strips forming a support plate disposed at said output side of the machine.

11. Chain conveyor according to claim 1, wherein said support strip is disposed at said input side of the machine, and including another support strip disposed at said output side of the machine.

* * * * *